United States Patent [19]

Garwood et al.

[11] 4,313,821

[45] Feb. 2, 1982

[54] PROCESSING OF COAL LIQUEFACTION PRODUCTS

[75] Inventors: William E. Garwood, Haddonfield, N.J.; Sterling E. Voltz, Media, Pa.; Ellen L. Wu, Glassboro, N.J.

[73] Assignee: Mobil Oil Corporation, New York, N.Y.

[21] Appl. No.: 128,658

[22] Filed: Mar. 10, 1980

Related U.S. Application Data

[63] Continuation of Ser. No. 941,437, Sep. 11, 1978, abandoned.

[51] Int. Cl.[3] ..... C10G 25/05

[52] U.S. Cl. ..... 208/245; 208/208 R; 208/250; 208/254 R; 208/303; 585/822

[58] Field of Search ..... 208/254 R, 208 R, 230, 208/245, 250

[56] References Cited

U.S. PATENT DOCUMENTS

| | | | |
|---|---|---|---|
| 2,566,353 | 9/1951 | Mills | 208/254 R |
| 2,766,178 | 10/1956 | Johnstone | 208/254 R |
| 2,925,379 | 2/1960 | Fleck et al. | 208/254 R |
| 2,984,620 | 5/1961 | Fleck et al. | 208/254 R |
| 3,019,182 | 1/1962 | Chanmugam | 208/254 R |
| 3,051,646 | 8/1962 | Brooke | 208/250 |
| 3,211,644 | 10/1965 | Clark | 208/245 |
| 3,218,250 | 11/1965 | Henke et al. | 208/250 |
| 3,282,831 | 11/1966 | Hamm | 208/208 R |
| 3,409,691 | 11/1968 | Small | 208/208 R |
| 4,137,154 | 1/1979 | Audeh | 208/254 R |

*Primary Examiner*—Delbert E. Gantz
*Assistant Examiner*—O. Chaudhuri
*Attorney, Agent, or Firm*—Charles A. Huggett; Michael G. Gilman; Charles J. Speciale

[57] ABSTRACT

A process for removing undesirable elements, e.g. nitrogen, sulfur, oxygen, from the light organic liquid product derived from a solvent refined coal liquefaction process, while preserving octane number, which comprises the steps of (1) subjecting the light liquids to an ion-exchange resin treatment and (2) contacting the resulting ion-exchanged liquids with a zeolite acting as an adsorbent under specified conditions of space velocity, temperature and pressure.

11 Claims, No Drawings

PROCESSING OF COAL LIQUEFACTION PRODUCTS

This is a continuation, of application Ser. No. 941,437, filed Sept. 11, 1978, abandoned.

BACKGROUND OF THE INVENTION

1. Field of the Invention

This invention relates to a process for removing undesirable elements from light organic liquid products, obtained as a by-product of solvent refined coal liquefaction processes, while preserving octane number.

2. Description of the Prior Art

With ever increasing demands on fossil fuels as a source of energy and ever decreasing supplies of crude petroleum within the United States, the nation must turn more and more to the use of coal. Yet the people of this country have mandated through their representatives that they do not want the anticipated use of coal to degrade their environment.

The air pollutants of particular concern are nitrogen oxides, sulfur oxides and particulates. Nitrogen oxides are formed from nitrogen in air as well as organic nitrogen in the fuel, and their concentration is primarily a function of combustion parameters. Sulfur oxides and particulates are a function of the chemical composition of the fuel used.

Coal is liquefied by exposing it to hydrogen gas or a hydrogen-bearing solvent under pressure and, in many processes, in the presence of a catalyst. Temperatures are kept below 900° F. so that hydrocarbon molecules are not destroyed. Alternately, coal can be destructively distilled by heating in such a way that its volatile components are given off and can be condensed as a liquid. The net result is to add hydrogen or remove carbon, in the process shortening the length of the hydrocarbon molecular chains. Hydrogen is generated by gasifying a portion of the coal or of a coal residue in most schemes, and this is a substantial part of the cost of liquefaction. Sulfur content of the coal is also an important constraint, since hydrogen is also needed to remove this contaminant (as hydrogen sulfide gas) in proportion to the amount of sulfur present. In theory, it is somewhat easier and cheaper to make a heavy oil from coal suitable for a boiler fuel than a synthetic crude oil that can be refined to gasoline, since the crude oil product requires adding about twice as much hydrogen—between 5 and 10 percent of the coal's weight. Boiler fuels may also have an economic advantage in that they would supply a regulated market—the electric utility industry that now generates about 30 percent of its power with oil and natural gas—making commercial introduction somewhat easier.

The three direct general processes for converting coals to liquid fuels are: catalyzed hydrogenation, staged pyrolysis, and solvent refining (1,2). Each of these processes results in the production of a coal liquid which contains a variety of desirable and undesirable components. The desirable coal liquids are the oils-saturated and aromatic hydrocarbons and the resins-polar nonhydrocarbons.

The undesirable species are the asphaltenes and the carbenes-high molecular weight highly aromatic solids, and the carboids-polymerized coke-like materials. The undesirable elements: metals, sulfur, nitrogen, and oxygen are generally present in higher concentration in the asphaltene and carboid fractions. Under hydrogenolysis conditions, the conversion of coal to oil has been suggested to proceed via the following sequence (3): Coal→Asphaltene→Oil. Therefore, asphaltene generation and elimination are of great importance in the liquefaction process.

One commercial process for coal-to-liquids produces synthetic gasoline and other motor fuels, along with pipeline gas, ammonia, and other products. Coal is gasified to produce synthesis gas (carbon monoxide and hydrogen) and then, using the Fischer-Tropsch process, the synthesis gas is converted to a mixture of hydrocarbons.

Another process is the "Solvent Refined Coal" process, which is a method of dissolving coal to remove ash, reducing its sulfur content and lowering its average molecular weight. Pulverized coal is mixed with a solvent and hydrogen and heated until most of it dissolves. Gases including hydrogen sulfide are removed, as are ash and other undissolved solids. A fraction of the remaining liquid is recycled as the solvent, and the rest is product, a low-sulfur boiler fuel that is solid at room temperature but melts readily at about 375° F.

It is the light organic liquid derived from the Solvent Refined Coal (SRC) process that is the starting material of this invention.

1. Burke, D. P., Chem. Week, 115, 38 (1974).
2. Cochran, N. P., Sci. Amer., 234, 24 (1976).

SUMMARY OF THE INVENTION

In accordance with the invention, there is now provided a process for removing undesirable elements from the aforementioned (SRC) light organic liquid, and at the same time preserving, or even enhancing, octane number, which comprises the steps of (1) subjecting the light organic liquids to an ion-exchange resin treatment and (2) contacting the resulting ion-exchanged liquids with a zeolite acting as an adsorbent under specified conditions of liquid hourly space velocity, temperature and pressure. The ion-exchange resin is the class of acid ion exchange resins exemplified by Amberlyst-15 Amberlyst XN-1005, Amberlyst XN-1010, Amberlyst XN-1011, Amberlyst XN-1008, Amberlite 200 and Amberlite IR-120H, with Amberlyst 15 particularly preferred (see U.S. Pat. No. 3,855,342 for further description of the resins), while the zeolite adsorbent is the class of zeolites exemplified by ZSM-5, ZSM-11, ZSM-12 and ZSM-35 with ZSM-5 particularly preferred (see U.S. Pat. Nos. 3,702,886; 3,709,979; 3,832,449; and 4,016,245, respectively).

DESCRIPTION OF THE PREFERRED EMBODIMENTS

Describing now the inventive process in further detail, the light organic liquid product from the solvent refined coal (SRC) liquefaction process is separated from the recycle solvent by flask distillation and amounts to about 10–30 wt % of the total product yield. It boils in the gasoline range; however it has high nitrogen (0.2–0.3 wt %) and oxygen (5–6 wt %) contents along with a reasonable, low sulfur (~0.5 wt %). Further processing is thus necessary to reduce these heteroatoms down to an acceptable level for use as a gasoline.

The high nitrogen content precludes conventional processing using acidic catalysts (such as ZSM-5), since nitrogen compounds poison the acid sites. Also, hydrogenative processing (over $Co/Mo/Al_2O_3$, $Pd/Al_2O_3$, etc) would require such severity to hydrogenate the nitrogen compounds that many of the aromatic rings would also be hydrogenated, giving a low octane gasoline.

We have found that the major amount of nitrogen compounds can be selectively removed from the SRC light organic liquid by a simple, room temperature contact with an organic resin, e.g. Amberlyst 15, a registered Trademark of Rohm & Haas, Co. or the like.

The remaining liquid, having about the same oxygen and sulfur content as the original liquid, can then be treated with acidic catalysts or hydrogenated under milder conditions to remove oxygen and sulfur without destroying aromatics, thereby preserving high octane number.

By gasoline boiling range material is meant any hydrocarbon or petroleum type material boiling in the naphtha or gasoline boiling range (75° to about 440° F.), and includes hydrocarbons in the range $C_5$–$C_{12}$. HZSM-5 zeolite which has a wide variety of uses as a catalyst or adsorbent may be found described in U.S. Patent No. 3,702,886. Liquid hourly space velocity is defined as the ccs. of liquid charged per cc of catalyst per hour.

In accord with the foregoing, it was found surprising that the Amberlyst ion-exchange resin would be so selective for nitrogen compounds, since in the upper boiling range of the gasoline more than one heteroatom per molecule is common. Subsequent treatment over HZSM-5 removed even more nitrogen, as well as sulfur and oxygen, the later of which was not significantly removed by the ion-exchange resin.

In order to more fully explain the invention, the following non-limitative examples are presented.

EXAMPLES 1–3

A sample of SRC light organic liquid was passed over HZSM-5 extrudate at 1 LHSV, atmospheric pressure, at temperatures of 703°, 756° and 806° F., respectively, for periods of 4, 5½ and 16 hours, respectively. Properties of the SRC charging liquid and analytical data from the examples are detailed in Table 1 immediately hereinbelow.

TABLE 1

CATALYST - HZSM-5 Extrudate, (30–60 Mesh)
CONDITIONS - 1 LHSV, Atmospheric Pressure

| EXAMPLE | | 1 | 2 | 3 |
|---|---|---|---|---|
| Temp., °F. | C | 703 | 756 | 806 |
| Run Time, Hours | h | 4 | 5½ | 16 |
| Products, Wt % | a | | | |
| $C_1$ & $C_2$ | r | <0.1 | <0.1 | <0.1 |
| $C_3$ | g | <0.1 | 0.2 | 0.6 |
| $C_4$ | e | 0.2 | 1.1 | 1.7 |
| $C_5$ | | 0.3 | 1.3 | 1.7 |
| $C_6$+ | 100 | 99.5 | 97.4 | 96.0 |
| Liquid Product Analysis | | | | |
| Gravity, °API | 25.9 | — | 23.4 | 23.8 |
| Gravity, Specific | .8990 | — | .9135 | .9111 |
| Oxygen, Wt % | 5.15 | 4.85 | 4.51 | 4.78 |
| Nitrogen, Wt % | 0.23 | — | 0.15 | 0.20 |
| Sulfur, Wt % | 0.40 | — | 0.30 | 0.32 |
| Sim. Dist. | | | | |
| IBP | 175 | 165 | 115 | 109 |
| 5% | 253 | 242 | 239 | 244 |
| 10% | 283 | 278 | 277 | 276 |
| 20% | 322 | 319 | 321 | 318 |
| 30% | 346 | 344 | 354 | 349 |
| 40% | 357 | 354 | 366 | 361 |
| 50% | 369 | 368 | 377 | 372 |
| 60% | 385 | 388 | 397 | 389 |
| 70% | 399 | 398 | 406 | 400 |
| 80% | 412 | 410 | 419 | 412 |
| 90% | 423 | 429 | 441 | 424 |
| 95% | 450 | 455 | 466 | 451 |

TABLE 1-continued

CATALYST - HZSM-5 Extrudate, (30–60 Mesh)
CONDITIONS - 1 LHSV, Atmospheric Pressure

| EXAMPLE | | 1 | 2 | 3 |
|---|---|---|---|---|
| 98% | 483 | 503 | 512 | 484 |
| Octane No., R + O (Minimicro) | 99.9 | 100.5 | — | 100.5 |

It can be seen from the foregoing that essentially no reaction took place, although oxygen, nitrogen and sulfur content were reduced somewhat, and octane number (R+O) was preserved, if not somewhat enhanced.

EXAMPLE 4

Three hundred cc (268.3 g) of the liquid was poured into a one liter Erlenmeyer flask, 30 g of 16–50 mesh Amberlyst beads added, and the mixture gently agitated on a stir-plate at room temperature overnight (17 hours). A 10 gram sample of supernatant liquid was withdrawn and analyzed; it contained 0.056 wt % nitrogen. Continued contact for an additional four days made no further change (0.055 wt % nitrogen). Recovery of total supernatant liquid (separated from wet Amberlyst beads by filtration through paper) was 221.4 g, or 83 wt %. Analysis compared with the charge is as follows:

| | Untreated | Treated |
|---|---|---|
| Gravity, °API | 25.9 | 24.0 |
| Specific | 0.8990 | 0.9100 |
| Nitrogen, Wt % | 0.23 | 0.055 |
| Oxygen, Wt % | 5.15 | 4.65 |
| Sulfur, Wt % | 0.40 | 0.43 |
| Boiling Range, °F. | | |
| IBP | 175 | 174 |
| 5% | 253 | 250 |
| 10 | 283 | 275 |
| 20 | 322 | 316 |
| 30 | 346 | 333 |
| 40 | 357 | 341 |
| 50 | 369 | 360 |
| 60 | 385 | 372 |
| 70 | 399 | 390 |
| 80 | 412 | 400 |
| 90 | 423 | 412 |
| 95 | 450 | 432 |
| 98 | 483 | 461 |
| Octane No., R + O | 99.9 | 98.6 |

The 17 wt percent of the SRC light organic liquid adsorbed on the Amberlyst beads (not desorbed) would be expected to contain 1.08 wt percent nitrogen, nearly a 5-fold enrichment.

EXAMPLE 5

The Amberlyst treated liquid which contained 0.055 wt % nitrogen compared to 0.23 wt % nitrogen in the original liquid (treatment described in Example 4), was passed over HZSM-5 at 700° F. Very little cracking occurred (99 wt % $C_5$+), ani the octane No. (R+O) increased from 98.6 to 100.9. Heteroatom removal (based on original liquid) was as follows:

| | Amberlyst 15 Treat | Then HZSM-5 700° F. |
|---|---|---|
| N Removal, wt % | 76 | 87 |
| S Removal, wt % | Nil | 27 |
| O Removal, wt % | 10 | 13 |

-continued

| | Amberlyst 15 Treat | Then HZSM-5 700° F. |
|---|---|---|
| Octane No. (R + O) | 98.6 | 100.9 |

This example demonstrates very high nitrogen removal with preservation, indeed enhancement of octane number. Sulfur removal over HZSM-5 went from essentially zero originally to 27 wt %. Complete listing of analytical data may be found in Table 2, below.

EXAMPLES 6 AND 6A

The Amberlyst 15 treatment was made by "dripping" the charge liquid over a column of Amberlyst, rather than agitating on a stir plate as in Example 5. The treated liquid recovery was the same as in Example 5 (83 wt %) but nitrogen removal was more complete (0.036 compared to 0.055 wt %). The treated liquid was then passed over HZSM-5 at 800° F. Again little cracking took place (98 wt % $C_5$+) and the octane number (R+O) increased from 98.1 to 99.2. A difference in this example is that the liquid product boils significantly lower throughout the boiling range which improves its volatility characteristics. Heteroatom removal was as follows:

-continued

| | Example 6 Amberlyst 15 Treat | Example 6A Then HZSM-5, 800° F. |
|---|---|---|
| N Removal, wt % | 84 | 88 |
| S Removal, wt % | Nil | 30 |
| O Removal, wt % | 22 | 23 |
| Octane No. (R + O) | 98.1 | 99.2 |

Again this example demonstrates very high nitrogen removal with enhancement of octane number. Sulfur removal over HZSM-5 went from zero to 30 wt. percent.

Table 2 set forth immediately hereinbelow sets forth the correlative data obtained from all of the foregoing examples.

TABLE 2

PROCESSING OF SRC LIGHT ORGANIC LIQUID OVER HZSM-5 EXTRUDATE BEFORE AND AFTER TREATMENT OF LIQUID WITH AMBERLYST 15 BEADS

| EXAMPLE NOS. | | 1 | 2 | 3 | 4 | 5 | 6 | 6A |
|---|---|---|---|---|---|---|---|---|
| Temp. Av. Cat., °F. | Charge | 703 | 756 | 806 | Charge | 701 | Charge | 798 |
| LHSV | | 1.00 | 0.95 | 0.93 | | 1.03 | | 1.04 |
| Pressure | | | Armospheric | | | Atmos. | | Atmos. |
| Run Time, Hours | | 4 | 542 | 16 | | 21 | | 21½ |
| Products, wt % | Untreated | | | | Treated With Amberlyst[1] | | Treated With Amberlyst[2] | |
| $C_1 + C_2$ | | <0.1 | <0.1 | <0.1 | | <0.1 | | 0.1 |
| $C_3$ | | <0.1 | 0.2 | 0.6 | | 0.4 | | 0.9 |
| $C_4$ | | 0.2 | 1.1 | 1.7 | | 0.8 | | 1.1 |
| $C_5$ | | 0.3 | 1.3 | 1.7 | | 1.0 | | 1.6 |
| $C_6$+ | | 99.5 | 97.4 | 96.0 | | 97.8 | | 96.3 |
| Liquid Analysis | | | | | | | | |
| Gravity, °API | 25.9 | — | 23.4 | 23.8 | 24.0 | 24.4 | 24.2 | 25.6 |
| Gravity, Specific | 0.8990 | — | 0.9135 | 0.9111 | 0.9100 | 0.9076 | 0.9088 | 0.9007 |
| Boiling Range, °F. | | | | | | | | |
| IBP | 175 | 165 | 115 | 109 | 174 | 51 | 163 | 6 |
| 5% | 253 | 242 | 239 | 244 | 250 | 240 | 247 | 197 |
| 10 | 283 | 278 | 277 | 276 | 275 | 287 | 279 | 243 |
| 20 | 322 | 319 | 321 | 318 | 316 | 330 | 320 | 288 |
| 30 | 346 | 344 | 354 | 349 | 333 | 344 | 334 | 303 |
| 40 | 357 | 354 | 366 | 361 | 341 | 362 | 349 | 315 |
| 50 | 369 | 368 | 377 | 372 | 360 | 377 | 362 | 327 |
| 60 | 385 | 388 | 397 | 389 | 372 | 389 | 374 | 337 |
| 70 | 399 | 398 | 406 | 400 | 390 | 411 | 399 | 361 |
| 80 | 412 | 410 | 419 | 412 | 400 | 421 | 409 | 371 |
| 90 | 423 | 429 | 441 | 424 | 412 | 440 | 420 | 377 |
| 95 | 450 | 455 | 466 | 451 | 432 | 458 | 447 | 404 |
| 98 | 483 | 503 | 512 | 484 | 461 | 486 | 482 | 411 |
| Octane No., R + O | 99.9 | 100.5 | — | 100.5 | 98.6 | 100.9 | 98.1 | 99.2 |
| Nitrogen, Wt % | 0.23 | — | 0.15 | 0.20 | 0.055 | 0.031 | 0.036 | 0.028 |
| Sulfur, Wt % | 0.40 | — | 0.30 | 0.32 | 0.43 | 0.29 | 0.47 | 0.28 |
| Oxygen, Wt % | 5.15 | 4.85 | 4.51 | 4.78 | 4.65 | 4.50 | 4.04 | 3.95 |
| Nitrogen Removal, Wt % | — | — | 35 | 13 | 76 | 87 | 84 | 88 |
| Sulfur Removal, Wt % | — | — | 25 | 20 | NIL | 27 | NIL | 30 |
| Oxygen Removal, Wt % | — | 6 | 12 | 7 | 10 | 13 | 22 | 23 |

[1]Recovery of treated liquid 83 wt % of charge (remainder adsorbed on Amberlyst 15)

[2]783 g charge liquid "dripped" thru 1759 Amberlyst 15 "Super Resin" in ~1" dia. glass column in ~40 hours. Recovery of treated liquid 83 wt % of charge. Resin has 2 meg. acid sites per gram, total meg = 2 × 175 = 350. Charge has 783 × 0.23 ÷ 14 = 128 meg. N. there are thus 2.74 sites available for each N or 174% excess.

What is claimed is:

1. A process for removing undesirable components from the light organic liquid by-products of Solvent Refined Coal liquefaction processes containing the same, said by-products boiling in the gasoline range and having a specified octane number which comprises the steps of (1) subjecting said light organic liquid by-products to an ion-exchange resin treatment allowing adsorption of at least a portion of said undesirable components by said ion-exchange resin, and (2) contacting the resultingly partially undesirable component-depleted light organic liquid with a zeolite acting as an adsorbent for the remaining undesirable components in said depleted light organic liquid, thereby further reducing the concentration of same under controlled conditions of space velocity, temperature, and pressure, while simultaneously preserving or enhancing the octane number of said light organic liquid by-products.

2. A process for removing nitrogen, sulfur and oxygen components from the light organic liquid by-products of Solvent Refined Coal liquefaction processes containing the same, said by-products boiling in the gasoline range and having a specified octane number, which comprises the steps of (1) subjecting said light organic liquid by-products to an ion-exchange resin treatment allowing adsorption of major amounts of the nitrogen component and minor amounts of the sulfur and oxygen components by said ion-exchange resin, and (2) contacting the resultingly nitrogen, sulfur, oxygen component-depleted light organic liquid with a zeolite acting as an adsorbent for the remaining nitrogen, sulfur, and oxygen components in said depleted light organic liquid, thereby further reducing the concentration of said remaining components, under controlled conditions of space velocity, temperature and pressure, while simultaneously preserving or enhancing the octane number of said light organic liquid by-products.

3. A process according to claim 1 wherein the step 2 liquid hourly space velocity is between about 0.1 and 10, said temperature is between about 700° and 800° F. and said pressure is atmospheric.

4. A process according to claim 2 wherein the step 2 liquid hourly space velocity is between about 0.1 and 10, said temperature is between about 700° and 800° F. and said pressure is atmospheric.

5. A process according to claim 1 wherein said zeolite is selected from ZSM-5, ZSM-11, ZSM-12 and ZSM-35, and said ion-exchange resin is selected from Amberlyst 15, Amberlyst XN-1005, Amberlyst XN-1010, Amberlyst XN-1011, Amberlyst XN-1008, Amberlite 200, and Amberlite IR-120H.

6. A process according to claim 2 wherein said zeolite is selected from ZSM-5, ZSM-11, ZSM-12 and ZSM-35, and said ion-exchange resin is selected from Amberlyst 15, Amberlyst XN-1005, Amberlyst XN-1010, Amberlyst XN-1011, Amberlyst XN-1008, Amberlite 200, and Amberlite IR-120H.

7. A process according to claim 5 wherein said ZSM-5 zeolite is HZSM-5 and said ion-exchange resin is Amberlyst 15.

8. A process according to claim 6 wherein said ZSM-5 zeolite is HZSM-5 and said ion-exchange resin is Amberlyst 15.

9. A process for removing nitrogen components from the light organic liquid by-products of Solvent Refined Coal liquefaction processes containing the same, said by-products boiling in the gasoline range and having a specified octane number, which comprises the steps of (1) subjecting said light organic liquid by-products to an ion-exchange resin treatment allowing adsorption of major amounts of said nitrogen components by said ion-exchange resin, and (2) contacting the resultingly nitrogen depleted light organic liquid with a zeolite acting as an adsorbent for at least a portion of the remaining nitrogen, thereby further and substantially reducing the concentration of said nitrogen, under controlled contact conditions of space velocity, temperature and pressure, while simultaneously preserving or enhancing the octane number of said light organic liquid by-products.

10. A process according to claim 9 wherein said ion-exchange resin is selected from Amberlyst 15, Amberlyst XN-1005, Amberlyst XN-1010, Amberlyst XN-1011, Amberlyst XN-1008, Amberlite 200, and Amberlite IR-120H, and said zeolite is selected from ZSM-5, ZSM-11, ZSM-12, and ZSM-35.

11. A process according to claim 10 wherein said ion-exchange resin is Amberlyst 15 and said ZSM-5 zeolite is HZSM-5, and wherein liquid hourly space velocity is between about 0.1 and 10, temperature is between about 700° and 800° F. and pressure is atmospheric.

* * * * *